US005885758A

United States Patent [19]

Bertucci et al.

[11] Patent Number: 5,885,758

[45] Date of Patent: Mar. 23, 1999

[54] PERIODATE PHOTOGRAPHIC BLEACHING METHOD WITHOUT ACIDIC PREBATH

[75] Inventors: Sidney J. Bertucci; Eric R. Schmittou, both of Rochester, N.Y.

[73] Assignee: Eastman Kodak Company, Rochester, N.Y.

[21] Appl. No.: 984,268

[22] Filed: Dec. 3, 1997

[51] Int. Cl.[6] ..... G03C 7/42

[52] U.S. Cl. ..... 430/430; 430/393

[58] Field of Search ..... 430/393, 430

[56] References Cited

U.S. PATENT DOCUMENTS

| | | | |
|---|---|---|---|
| 3,960,565 | 6/1976 | Fisch et al. | 430/393 |
| 5,318,880 | 6/1994 | English et al. | 430/393 |
| 5,441,665 | 8/1995 | Massaioli | 252/142 |
| 5,464,728 | 11/1995 | Szajewski et al. | 430/393 |
| 5,508,151 | 4/1996 | O'Toole et al. | 430/393 |
| 5,521,056 | 5/1996 | Buchanan et al. | 430/430 |
| 5,641,615 | 6/1997 | Haye et al. | 430/430 |

*Primary Examiner*—Hoa Van Le
*Attorney, Agent, or Firm*—J. Lanny Tucker

[57] ABSTRACT

Color photographic elements are processed with a highly acidic periodate bleaching solution including a rehalogenating agent and a strong acid. Bleaching is carried out after color development without any intervening processing steps, such as an acidic prebath. The processing method provides rapid bleaching without physical defects such as blistering or vesiculation, and minimizes the formation of Dmin.

13 Claims, No Drawings

PERIODATE PHOTOGRAPHIC BLEACHING METHOD WITHOUT ACIDIC PREBATH

RELEVANT APPLICATION

Copending and commonly assigned U.S. Ser. No. 08/947,072, filed on Oct. 8, 1997 by Sidney J. Bertucci and Eric R. Schmittou, and entitled "Periodate Photographic Bleaching Compositions and Methods of Use."

FIELD OF THE INVENTION

The present invention relates generally to periodate photographic bleaching of color photographic elements without the use of an acidic prebath before the bleaching step.

BACKGROUND OF THE INVENTION

During processing of silver halide color photographic elements, the developed silver is oxidized to a silver salt by a suitable bleaching agent. The oxidized silver is then removed from the element in a fixing step.

The most common bleaching solutions are desirably acidic, and contain complexes of high valence metal ions, such as ferric ions, and various organic ligands. Both the metal ions and the chelating ligands present environmental concerns and are the subject of increasing regulatory scrutiny. Thus, a primary desire in this industry is to design bleaching compositions that are more compatible with the environment, with reduced use of high valent metal complex bleaching agents.

Bleaching solutions containing peroxide, or peracids such as persulfate, perborate, perphosphate, percarboxylic acid or percarbonate as bleaching agents offer an alternative to the ferric complex bleaching solutions. They are less expensive and present lower chemical and biological demands on the environment since their by-products can be less harmful. A number of such compositions have been explored, but to date they have not found wide acceptance in the trade for various reasons.

Various peroxide and peracid bleaching solutions are described, for example, in U.S. Pat. No. 5,318,880 (English et al), U.S. Pat. No. 5,464,728 (Szajewski et al), U.S. Pat. No. 5,508,151 (O'Toole et al) and U.S. Pat. No. 5,521,056 (Buchanan et al).

While persulfate bleaching agents have low environmental impact, they have the disadvantage that their bleaching activity is slow and thus requires the presence of a bleaching accelerator or the use of an accelerator prebath, as widely practiced to process motion picture films. The most common bleaching accelerators are thiols that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al), U.S. Pat. No. 5,550,009 (Haye et al), U.S. Pat. No. 5,541,041 (Haye), U.S. Pat. No. 5,641,615 (Haye et al), WO-A-92/01972 (published Feb. 6, 1992), WO-A-92/07300 (published Apr. 30, 1992) and EP 0 428 101A1 (published May 22, 1991). These compositions may comprise various amounts of chloride ions and have a pH in the range of 5 to 11.

Hydrogen peroxide bleaching compositions, however, often cause physical defects in the processed photographic elements, such as blistering (or vesiculation), and suffer long term stability problems at certain acidity levels. In addition, peroxide is ineffective in oxidizing developed silver to silver halide at acidic pH values, and thus it cannot be used to directly replace current high valent metal ligand bleaching solutions.

There is a desire and need in the photographic industry to find solutions to all of these problems. Thus, there is a need to avoid the use of bleaching accelerators and high valent metal bleaching agents while providing an effective acidic bleaching environment.

In copending and commonly assigned U.S. Ser. No. 08/947,072, filed on Oct. 8, 1997, noted above, useful acidic periodate bleaching compositions and methods of bleaching are described. However, such methods include the use of an acidic prebath immediately before bleaching.

The purpose of this acidic prebath is two-fold. Firstly, it serves as a wash solution to remove any residual color developing agent carried over by the processed element from the color developer solution. Secondly, it serves to lower the pH within the element layers to a level at which any incorporated dye forming color couplers are no longer reactive with oxidized color developing agent. Without the prebath before bleaching, the processed element would carry color developing agent into the bleaching solution, and this color developing agent would be oxidized by bleaching agent. Additionally, incorporated dye forming color couplers may still be reactive with oxidized color developing agent, forming additional dye. Since this dye formation would occur in a non-imagewise fashion, the newly formed dye would be seen as undesirable overall dye "stain" in the processed photographic element.

Yet, there remains a need in the art to eliminate the use of the acidic prebath so as to reduce the number of steps to be followed and solutions to be prepared and maintained. Thus, prebath elimination would increase processing time and productivity in a processing facility.

In order to process such photographic elements without the use of an acidic prebath, the bleaching solution must be sufficiently oxidizing to oxidize developed silver to a silver salt, but acidic enough to deactivate the reactive dye forming color couplers in the elements before they can react with color developing agent carried over from the color developer solution. With relatively weak oxidizing bleaching agents, such as chelated high valence metal ions (for example, the common ferric chelates of aminocarboxylic acids), bleaching compositions may be formulated over a wide range of acidity and bleaching agent concentration for silver oxidization without unwanted dye stain. These expectations can be characterized as the need to reduce residual silver in a processed element to below about 0.04 $g/m^2$, and to minimize dye stain, or minimum density (Dmin) in unexposed areas. Acceptable Dmin would be that obtained from comparable processing of the same element using an acidic prebath prior to the use of a conventional chelated iron bleaching agent.

When much stronger oxidants are used as bleaching agents, however, we discovered that there is less flexibility in formulating a bleaching composition that performs all of the desired functions without dye stain. For example, merely using the periodate bleaching compositions and methods described in our copending U.S. Ser. No. 08/947,072, noted above, in the absence of an acidic prebath, did not provide desired results. Bleaching was effective in most cases, but dye stain was unacceptably increased. Thus, there is a need to find a way to use a periodate bleaching composition in the absence of acidic prebath solutions.

SUMMARY OF THE INVENTION

The problems noted above are overcome with a method of processing comprising the steps of:

A) color developing an imagewise exposed silver halide color photographic element, and B) without intervening processing steps, bleaching the element with the bleaching composition having a pH of less than 2, and comprising:

a) periodate, or a source of periodate, at a concentration of from about 0.01 to about 0.05 mol/l, b) chloride ions at a concentration of at least 0.01 mol/l, and c) at least one acid with a pKa less than 2, at a concentration greater than or equal to 0.05 mol/l.

The periodate bleaching compositions useful in this invention can replace the peroxide or peracid solutions known in the art, and in some cases, can shorten the bleaching time. For example, bleaching of some silver chloride color photographic papers can be carried out in less than 30 seconds. Other elements also have shortened bleaching steps. In addition, the usual acidic prebath steps between color development and bleaching can be avoided with the careful formulation of pH and concentration of periodate bleaching agent in the bleaching composition. It functions both to stop color development as well as to rapidly bleach the developed photographic element.

Thus, the bleaching compositions used in the practice of this invention satisfy the two essential criteria noted above when acidic prebath solutions are eliminated: effective bleaching so that residual silver is less than about 0.04 $g/m^2$ of processed element, and minimal Dmin or dye stain in unexposed areas.

Unlike persulfate bleaching compositions, the periodate compositions useful in this invention do not require a bleaching accelerator to be effective. In addition, the high valent metal bleaching agents that present environmental concerns are avoided. Unlike peroxide bleaching compositions, the periodate bleaching compositions easily convert developed silver to silver halide at very acidic pH values (for example at a pH below 2). No physical defects (such as blistering or vesiculation) are observed in the processed elements.

DETAILED DESCRIPTION OF THE INVENTION

The method of this invention includes color developing a silver halide color photographic element using any of the conventional color developing solutions known in the art. Such solutions typically include one or more color developing agents, antioxidants (or preservatives), sequestrants, halides, buffers, and other addenda that would be known in the art. Particularly useful color developing agents include aminophenols and p-phenylenediamines, and particularly useful antioxidants include substituted and unsubstituted hydroxylamines, hydrazines, hydrazides, sulfites, a-amino acids, mono- and polysaccharides, and alcoholamines. By substituted hydroxylamines is meant, for example, those having one or more alkyl or aryl groups connected to the nitrogen atom. These alkyl or aryl groups can be further substituted with one or more groups such as sulfo, carboxy, carbamoyl, sulfamoyl, hydroxy, alkoxy, and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al), U.S. Pat. No. 5,354,646 (Kobayashi et al), U.S. Pat. No. 5,508,155 (Marrese et al), and WO US96/03016 (Eastman Kodak).

Development can also be carried out using what is known in the art as a "developer/amplifier" solution, as described in U.S. Pat. No. 5,324,624 (Twist).

The amounts of the components of the color developing solution would be those considered conventional in the art. Further details of useful color developing solutions are provided in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "*Research Disclosure*".

Following color development, without any intervening processing steps, such as acidic treatments or washes, the color photographic element is bleached using the periodate composition described herein. These compositions contain one or more suitable sources of periodate, including, but not limited to hydrogen, alkali and alkaline earth salts, or a compound which releases or generates periodate. Alkali metal periodates, such as sodium periodate, are preferred bleaching agents.

Periodate exists in different forms in solution as a function of pH (see for example, Cotton and Wilkinson, *Advanced Inorganic Chemistry*, 2nd Edition, Interscience Publishers, New York, 1966, pp. 572–4), so that the form or forms of periodate that are the active bleaching agent(s) may vary as the bleaching composition pH varies. However, the most convenient sources of the active form(s) of the periodate bleaching agent for the preparation of bleaching compositions are the water-soluble salts of meta- and paraperiodic acids.

The amount of periodate (or its precursor) is generally at least 0.01 mol/l, preferably from about 0.01 to about 0.05 mol/l, and more preferably from about 0.01 to about 0.025 mol/l.

The periodate bleaching compositions also include chloride ions as a rehalogenating agent. This rehalogenating agent can be supplied as part of a simple inorganic salt for example, sodium chloride, potassium chloride, ammonium chloride, lithium chloride, and others readily apparent to one skilled in the art. In addition, it can be supplied as an organic salt such as a tetraalkylammonium chloride. The preferred salts are potassium and sodium chlorides.

The concentration of the chloride ions is generally from about 0.01 to about 1 mol/l, preferably from about 0.01 to 0.1 mol/l.

The periodate compositions also include one or more acids, each having a pKa of less than 2, preferably less than 1.5, and more preferably less than 1. The total concentration of the acid(s) is greater than or equal to 0.05 mol/l, preferably greater than or equal to 0.1 mol/l.

The bleaching composition useful herein is highly acidic, having a pH less than 2, preferably less than 1.5, and more preferably, less than 1.25. The pH can be provided by adding at least one conventional strong acid, including, but not limited to, sulfuric acid, phosphoric acid and methanesulfonic acid. Sulfuric acid is preferred.

The bleaching compositions are quite simple, having only the essential components described above. However, they may also include one or more distinct phosphonic acid or carboxylic acid sequestering agents, or corrosion inhibitors (such as nitrate ion) in conventional amounts.

The periodate bleaching composition may be completely free of any purposely added complex of a high valent metal ion and any polycarboxylic acid, aminopolycarboxylic acid or phosphonic acid ligand. This does not mean that such complexes might not be carried over from the color developing solution into the bleaching bath, but if this occurs, the maximum concentration should be less than $1\times10^{-4}$ mol/l, and preferably less than $1\times10^{-4}$ mol/l, but clearly none of such complexes or the high valent metal ion to make such complexes, is purposely added to the bleaching compositions. Such carryover amounts are insufficient to perform the bleaching function. High valent metal ions are metal ions having a valence greater than +1, including iron(II), iron (III), copper(II), cobalt(II) and nickel(II).

Fixing of the processed element can be accomplished using any suitable fixing solution containing one or more suitable fixing agents. Representative fixing agents are described in *Research Disclosure*, noted above. Preferred fixing agents include thioethers, thiocyanates and thiosulfates. The components of the fixing solutions are present in conventional amounts.

The photographic elements processed using the present invention may be any suitable photographic color negative film, color reversal film, color paper, or motion picture films of all types. Each of these materials may be processed using a periodate bleaching composition in combination with the various conventional processing steps known in the art. The conditions, times and solutions used for such processing steps are well known or readily ascertained by a skilled worker in the art.

The photographic elements processed according to this invention can have any suitable combination of silver halide emulsion layers that are known in the art. The present invention is particularly useful to process photographic color papers, especially those having one or more predominantly silver chloride emulsions, meaning an emulsion having at least 50 mol % silver chloride. The other emulsions in the color paper can be the same or different, but preferably, all of the emulsions in the papers are predominantly silver chloride emulsions. Thus, the red, green and blue color records each have at least one predominantly silver chloride emulsion. More preferably, each emulsion has at least 90 mol % silver chloride, and most preferably, each emulsion has at least 95 mol % silver chloride. The predominantly silver chloride emulsions contain substantially no silver iodide, meaning less than 1 mol % of silver iodide. Any remaining silver halide in such emulsions is silver bromide.

The photographic emulsions used in these elements can have any suitable silver halide grain morphology including cubic, octahedral or tabular morphologies as described in numerous publications in the art, including *Research Disclosure*, noted above. Silver chloride emulsions can have tabular grains with {100} faces.

The photographic elements processed in the practice of this invention can be single or multilayer color elements. Multilayer color elements, such as multilayer color papers, are particularly suitable, and typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art.

The multicolor photographic elements processed according to this invention can advantageously have one or more appropriate cyan, yellow and magenta dye forming couplers in one or more silver halide emulsion layers. Various classes of such coupler compounds are known, as described in *Research Disclosure* noted above. Particularly useful magenta dye forming couplers include both two- and four-equivalent azole and pyrazole (especially two-equivalent pyrazolotriazole) couplers.

Considerably more details of the color photographic element structure and components are described in *Research Disclosure*, noted above. All types of emulsions can be used in the elements, including but not limited to, thin tabular grain emulsions, and either positive-working or negative-working emulsions, and the levels of silver coverage in the various types of elements can be any of those conventional in the industry. For example, the color papers processed using this invention have low total silver coverage, that is up to about 1 g/m$^2$, and preferably up to about 0.75 g/m$^2$.

The elements are typically exposed to suitable radiation to form a latent image and then processed as described above to form a visible dye image. The fixing step described above can be followed by one or more washing and/or stabilizing steps, then drying to provide the desired image.

Processing according to the present invention can be carried out using conventional processing equipment, including what are known in the art as "low volume thin tank" processing systems having either rack and tank or automatic tray designs. Such processing methods and equipment are described, for example, in U.S. Pat. No. 5,436,118 (Carli et al) and publications noted therein.

Bleaching according to the present invention is generally carried out for at least 30 seconds, and preferably at least 45 seconds. The maximum bleaching time will depend upon the type of element being processed. For example, high silver chloride color papers can be bleached in less than about 30 seconds.

Bleaching temperatures are generally from about 20° to about 50° C., and preferably from about 25° to about 45° C. Optimal bleaching temperatures can be readily determined for a given processed element with routine experimentation.

The following examples are presented to illustrate the practice of this invention, and are not intended to be limiting in any way. Unless otherwise indicated, all percentages are by weight.

Materials and Methods:

Unless otherwise indicated, the photographic elements processed in the examples were imagewise exposed for 0.1 second on a 1B sensitometer (3000K) through a 0–3 step chart and HA-50 and NP-11 filters. The elements were processed using the various processing protocols at 35° C.

The residual silver for each of the 21 steps in the 0–3 chart was measured using conventional X-ray fluorescence XRF). The measured values (g/m$^2$) are shown in the various tables. In those tables, "DF" represents a photographic element that has been developed and then fixed only. It gives the level of silver developed in the photographic process. This is the level of silver that needs to be bleached. "DBF" represents an element that has been developed, then bleached and fixed (full process). For a useful bleach, the silver levels in a DBF strip should be low, below about 0.040 g/m$^2$. "DB" represents an element that has been developed and bleached only (no fix). It is desirable for a bleach to be silver-retentive, that is, that all of the developed silver oxidized by the bleach should remain in the element until the fixing step. A bleach is silver retentive to the degree that the silver levels in the DB strip are similar at all exposure levels and on the order of the highest silver levels in the DF strip. Strip "DBF-1" gives the residual silver in an element fully processed in conventional processes using a conventional chelated iron bleaching agent. "DB-1" shows the silver level in the same element after the bleaching step in the conventional processes. Strip "DBF-2" gives the residual silver in an element fully processed in the method of this invention using a periodate bleaching composition within the scope of this invention, and Strip "DB-2" shows the silver level in the same element after the bleaching step in the method of this invention. Strip "DBF-3" gives the residual silver in an element fully processed using the method protocol of this invention but with a hydrogen peroxide, sodium persulfate or periodate bleaching composition outside of this invention, and "DB-3" shows the silver level in the same element after the bleaching step.

Minimum Status A reflection densities (Dmins) were measured on the fully processed film strips.

Processing solutions used in the examples include:

| | |
|---|---|
| Color Developer | |
| Water | 700.0 ml |
| Triethanolamine | 12.41 g |
| PHORWITE REU | 2.30 g |
| Lithium polystyrene sulfonate (30% solution) | 0.30 g |
| N,N-diethylhydroxylamine (85% solution) | 5.40 g |
| Lithium sulfate | 2.70 g |
| KODAK Color Developing Agent CD-3 | 5.00 g |
| 1 Hydroxyethyl-1,1-diphosphonic acid (60% solution) | 1.16 g |
| Potassium carbonate, anhydrous | 21.16 g |
| Potassium bicarbonate | 2.79 g |
| Potassium bromide | 7.00 mg |
| Water to make | 1.00 liter |
| pH = 10.04 (at 27° C.) | |
| Color Paper Bleaching Solution | |
| 1,3-Propanediaminetetraacetic acid (PDTA) | 15.40 g |
| Ferric nitrate, 9-hydrate | 18.30 g |
| Glacial acetic acid | 6.00 ml |
| 1,3-Diamino-2-propanoltetraacetic acid | 0.50 g |
| Potassium bromide | 23.90 g |
| Water to make | 1.00 liter |
| pH = 4.75 (at 25° C.) | |
| Fixing Solution | |
| Sodium thiosulfate | 42.60 g |
| Sodium sulfite | 18.60 g |
| Glacial acetic acid | 10.00 ml |
| Disodium ethylenediaminetetraacetate | 1.00 g |
| Water to make | 1.00 liter |
| pH = 6.50 (at 25° C.) | |

EXAMPLE 1

This example shows that a periodate bleaching composition can be used to replace three conventional processing solutions (acidic stop bath, water wash, and chelated iron bleaching solution) in the conventional "Separate Bleach and Fixer Option" for Process RA-4 used to process color photographic papers.

Conventional FUJICOLOR SUPER FA5 Color Paper was exposed and processed according to the following processing protocol.

| | Time (sec) | | | | |
|---|---|---|---|---|---|
| Solution | DF | DBF-1 | DB-1 | DBF-2 | DB-2 |
| Color Developer | 45 | 45 | 45 | 45 | 45 |
| Acidic Prebath | 30 | 30 | 30 | — | — |
| Water wash | 30 | 30 | 30 | — | — |
| Color Paper Bleaching Solution | — | 60 | 60 | — | — |
| Bleach A | — | — | — | 110 | 110 |
| Water wash | 120 | 60 | 60 | 60 | 60 |
| Fixing Solution | 60 | 60 | — | 60 | — |
| Water wash | 90 | 90 | 150 | 90 | 150 |

| | |
|---|---|
| Acidic Prebath | |
| Glacial acetic acid | 9.0 ml |
| Water to | 1 liter |
| Bleaching Composition A | |
| Sodium periodate | 2.14 grams |
| Sodium chloride | 0.88 grams |
| Sulfuric acid (0.18 molar in water) to pH = 0.79 | 1 liter |

The residual silver values are shown below in TABLE I, and the Dmin values are shown below in TABLE II. The data in TABLE I show that the method of this invention provides comparable silver retentive bleaching compared to the conventional method in which acidic prebath and washing steps were used. A comparison of the Dmin values shows that there was no increase in red, green or blue Dmin with the method of this invention.

TABLE I

| | Control | | Bleach A | |
|---|---|---|---|---|
| DF | DBF-1 | DB-1 | DBF-2 | DB-2 |
| 0.501 | 0.000 | 0.538 | 0.000 | 0.539 |
| 0.508 | 0.000 | 0.540 | 0.005 | 0.548 |
| 0.526 | 0.000 | 0.537 | 0.005 | 0.533 |
| 0.485 | 0.000 | 0.544 | 0.011 | 0.535 |
| 0.481 | 0.004 | 0.543 | 0.005 | 0.535 |
| 0.490 | 0.000 | 0.542 | 0.004 | 0.552 |
| 0.455 | 0.000 | 0.524 | 0.010 | 0.550 |
| 0.443 | 0.003 | 0.540 | 0.000 | 0.537 |
| 0.423 | 0.000 | 0.533 | 0.001 | 0.538 |
| 0.330 | 0.000 | 0.531 | 0.000 | 0.537 |
| 0.219 | 0.002 | 0.533 | 0.000 | 0.536 |
| 0.145 | 0.001 | 0.540 | 0.000 | 0.543 |
| 0.073 | 0.000 | 0.544 | 0.003 | 0.535 |
| 0.031 | 0.000 | 0.535 | 0.000 | 0.540 |
| 0.008 | 0.009 | 0.526 | 0.006 | 0.550 |
| 0.000 | 0.000 | 0.533 | 0.000 | 0.542 |
| 0.000 | 0.000 | 0.550 | 0.000 | 0.543 |
| 0.002 | 0.000 | 0.542 | 0.004 | 0.543 |
| 0.002 | 0.005 | 0.523 | 0.003 | 0.541 |
| 0.000 | 0.000 | 0.552 | 0.000 | 0.541 |
| 0.002 | 0.000 | 0.538 | 0.000 | 0.538 |

TABLE II

| | Dmin | | |
|---|---|---|---|
| | R | G | B |
| DBF-1 (control) | 0.119 | 0.119 | 0.136 |
| DBF-2 (invention) | 0.119 | 0.118 | 0.137 |

Comparative Example 1

This example shows that if hydrogen peroxide or sodium persulfate is substituted (on an equimolar basis) for periodate as the bleaching agent in Bleaching Composition A and the method of Example 1 is repeated, bleaching of developed silver is not achieved. Thus, periodate is shown to be effective as a bleaching agent in the processing method of this invention while hydrogen peroxide and sodium persulfate, both common bleaching agents, are not.

The process of Example 1 was repeated, using either Bleaching Composition B or C.

| Bleaching Composition B | |
|---|---|
| Hydrogen peroxide (30 wt % in water) | 1.13 grams |
| Sodium chloride | 0.88 grams |
| Sulfuric acid (0.18 molar in water) to pH = 0.72 | 1 liter |
| **Bleaching Composition C** | |
| Sodium persulfate | 2.38 grams |
| Sodium chloride | 0.88 grams |
| Sulfuric acid (0.18 molar in water) to pH = 0.72 | 1 liter |

The residual silver values are shown below in TABLE III.

TABLE III

| | Bleach B | | Bleach C | |
|---|---|---|---|---|
| DF | DBF-3 | DB-3 | DBF-3 | DB-3 |
| 0.524 | 0.500 | 0.547 | 0.462 | 0.534 |
| 0.508 | 0.490 | 0.545 | 0.467 | 0.537 |
| 0.496 | 0.482 | 0.549 | 0.449 | 0.535 |
| 0.500 | 0.470 | 0.531 | 0.457 | 0.531 |
| 0.485 | 0.457 | 0.540 | 0.450 | 0.538 |
| 0.487 | 0.452 | 0.525 | 0.446 | 0.539 |
| 0.482 | 0.432 | 0.529 | 0.419 | 0.536 |
| 0.443 | 0.408 | 0.539 | 0.400 | 0.540 |
| 0.412 | 0.392 | 0.531 | 0.373 | 0.545 |
| 0.316 | 0.301 | 0.536 | 0.292 | 0.539 |
| 0.226 | 0.218 | 0.540 | 0.205 | 0.531 |
| 0.139 | 0.123 | 0.539 | 0.126 | 0.527 |
| 0.067 | 0.065 | 0.542 | 0.060 | 0.541 |
| 0.027 | 0.028 | 0.530 | 0.022 | 0.543 |
| 0.016 | 0.014 | 0.542 | 0.000 | 0.544 |
| 0.000 | 0.000 | 0.523 | 0.000 | 0.542 |
| 0.002 | 0.001 | 0.523 | 0.001 | 0.539 |
| 0.003 | 0.000 | 0.544 | 0.000 | 0.547 |
| 0.012 | 0.005 | 0.525 | 0.005 | 0.535 |
| 0.000 | 0.009 | 0.537 | 0.000 | 0.529 |
| 0.000 | 0.001 | 0.531 | 0.000 | 0.525 |

EXAMPLE 2

Raid Processing

This example demonstrates rapid bleaching in a shortened process of this invention. Samples of conventional FUJICOLOR SUPER FA5 Color Paper were exposed and processed as in Example 1 except that Bleach A was replaced with Bleaching Composition D and the time for bleaching was reduced to 30 seconds. Thus, the 120 seconds total application time of the acidic prebath, the water wash and the Color Paper Bleaching Solution in the control process was replaced by the 30 seconds bleaching time in the invention process. The residual silver values are shown in Table IV. Table V shows that the Dmin values for the invention were comparable to the conventional process.

| Bleaching Composition D | |
|---|---|
| Sodium periodate | 3.21 grams |
| Sodium chloride | 0.88 grams |
| Sulfuric acid (0.18 molar in water) to pH = 0.76 | 1 liter |

TABLE IV

| DF | DBF-1 | DB-1 | DBF-2 | DB-2 |
|---|---|---|---|---|
| 0.499 | 0.010 | 0.540 | 0.010 | 0.530 |
| 0.515 | 0.003 | 0.533 | 0.014 | 0.541 |
| 0.515 | 0.010 | 0.531 | 0.010 | 0.531 |
| 0.508 | 0.009 | 0.535 | 0.014 | 0.549 |
| 0.487 | 0.002 | 0.541 | 0.003 | 0.542 |
| 0.478 | 0.003 | 0.527 | 0.012 | 0.570 |
| 0.471 | 0.000 | 0.523 | 0.019 | 0.536 |
| 0.452 | 0.000 | 0.539 | 0.014 | 0.549 |
| 0.400 | 0.008 | 0.524 | 0.003 | 0.533 |
| 0.343 | 0.005 | 0.545 | 0.009 | 0.534 |
| 0.243 | 0.001 | 0.543 | 0.000 | 0.540 |
| 0.142 | 0.000 | 0.535 | 0.011 | 0.547 |
| 0.082 | 0.000 | 0.548 | 0.011 | 0.543 |
| 0.031 | 0.008 | 0.533 | 0.000 | 0.527 |
| 0.011 | 0.012 | 0.529 | 0.000 | 0.536 |
| 0.002 | 0.004 | 0.526 | 0.000 | 0.548 |
| 0.011 | 0.005 | 0.531 | 0.002 | 0.539 |
| 0.010 | 0.000 | 0.535 | 0.002 | 0.530 |
| 0.003 | 0.009 | 0.534 | 0.001 | 0.529 |
| 0.014 | 0.000 | 0.536 | 0.000 | 0.526 |
| 0.002 | 0.002 | 0.537 | 0.004 | 0.528 |

TABLE V

| | Dmin | | |
|---|---|---|---|
| | R | G | B |
| DBF-1 (control) | 0.118 | 0.117 | 0.136 |
| DBF-2 (invention) | 0.122 | 0.122 | 0.141 |

EXAMPLE 3

This example demonstrates bleaching of commercially available KONICACOLOR QA TYPE A6E Color Paper using the present invention and 10 comparing the invention to processing using the "Separate Bleach and Fixer Option" for conventional Process RA-4. Samples of the color paper were exposed and processed as in Example 1. The residual silver values are shown below in TABLE VI. TABLE VII shows that the Dmin values for the invention were comparable to the conventional process.

TABLE VI

| | Control | | Bleach A | |
|---|---|---|---|---|
| DF | DBF-1 | DB-1 | DBF-2 | DB-2 |
| 0.470 | 0.000 | 0.499 | 0.001 | 0.498 |
| 0.472 | 0.000 | 0.497 | 0.011 | 0.499 |
| 0.476 | 0.002 | 0.493 | 0.000 | 0.511 |
| 0.467 | 0.000 | 0.502 | 0.014 | 0.501 |
| 0.469 | 0.005 | 0.505 | 0.000 | 0.494 |
| 0.462 | 0.000 | 0.493 | 0.000 | 0.498 |
| 0.444 | 0.000 | 0.499 | 0.002 | 0.492 |
| 0.431 | 0.000 | 0.494 | 0.006 | 0.501 |
| 0.365 | 0.000 | 0.506 | 0.000 | 0.497 |

TABLE VI-continued

| | Control | | Bleach A | |
|---|---|---|---|---|
| DF | DBF-1 | DB-1 | DBF-2 | DB-2 |
| 0.272 | 0.000 | 0.497 | 0.000 | 0.500 |
| 0.193 | 0.000 | 0.499 | 0.000 | 0.498 |
| 0.086 | 0.000 | 0.502 | 0.000 | 0.493 |
| 0.042 | 0.000 | 0.503 | 0.000 | 0.505 |
| 0.012 | 0.000 | 0.499 | 0.000 | 0.495 |
| 0.000 | 0.000 | 0.514 | 0.000 | 0.495 |
| 0.000 | 0.000 | 0.500 | 0.000 | 0.502 |
| 0.001 | 0.002 | 0.501 | 0.000 | 0.495 |
| 0.000 | 0.000 | 0.497 | 0.002 | 0.496 |
| 0.003 | 0.000 | 0.477 | 0.000 | 0.494 |
| 0.000 | 0.000 | 0.494 | 0.000 | 0.508 |
| 0.000 | 0.000 | 0.498 | 0.001 | 0.521 |

TABLE VII

| | Dmin | | |
|---|---|---|---|
| | R | G | B |
| DBF-1 (control) | 0.094 | 0.087 | 0.099 |
| DBF-2 (invention) | 0.096 | 0.093 | 0.109 |

EXAMPLE 4

This example demonstrates bleaching of commercially available AGFACOLOR TYPE 10 Color Paper using the present invention and comparing the invention to processing using the "Separate Bleach and Fixer Option" for conventional Process RA-4. Samples of the color paper were exposed and processed as in Example 1. The residual silver values are shown in Table VIII. Table IX shows that the Dmin values obtained using the invention were comparable to those measured when the control bleach (of Example 1) was used.

TABLE VIII

| | Control | | Bleach A | |
|---|---|---|---|---|
| DF | DBF-1 | DB-1 | DBF-2 | DB-2 |
| 0.640 | 0.008 | 0.656 | 0.029 | 0.653 |
| 0.613 | 0.000 | 0.653 | 0.002 | 0.669 |
| 0.625 | 0.006 | 0.662 | 0.028 | 0.653 |
| 0.636 | 0.001 | 0.651 | 0.022 | 0.657 |
| 0.608 | 0.000 | 0.652 | 0.029 | 0.673 |
| 0.602 | 0.008 | 0.650 | 0.023 | 0.662 |
| 0.568 | 0.004 | 0.651 | 0.026 | 0.644 |
| 0.514 | 0.009 | 0.658 | 0.016 | 0.650 |
| 0.431 | 0.000 | 0.651 | 0.014 | 0.638 |
| 0.318 | 0.006 | 0.656 | 0.011 | 0.651 |
| 0.211 | 0.005 | 0.646 | 0.000 | 0.671 |
| 0.108 | 0.006 | 0.637 | 0.004 | 0.656 |
| 0.059 | 0.001 | 0.658 | 0.013 | 0.661 |
| 0.027 | 0.009 | 0.643 | 0.000 | 0.638 |
| 0.011 | 0.000 | 0.656 | 0.000 | 0.667 |
| 0.004 | 0.002 | 0.656 | 0.005 | 0.658 |
| 0.002 | 0.012 | 0.652 | 0.014 | 0.670 |
| 0.003 | 0.000 | 0.654 | 0.000 | 0.664 |
| 0.003 | 0.004 | 0.644 | 0.006 | 0.648 |
| 0.000 | 0.002 | 0.637 | 0.010 | 0.671 |
| 0.003 | 0.002 | 0.638 | 0.005 | 0.653 |

TABLE IX

| | Dmin | | |
|---|---|---|---|
| | R | G | B |
| DBF-1 (control) | 0.114 | 0.107 | 0.117 |
| DBF-2 (invention) | 0.110 | 0.112 | 0.123 |

EXAMPLE 5

This example demonstrates bleaching of KODAK EDGE 5 Color Paper using the present invention and comparing it to the "Separate Bleach and Fixer Option" for conventional Process RA-4. Samples of the color paper were exposed and processed as in Example 1. The residual silver values are shown below in TABLE X. TABLE XI shows the Dmin values obtained using the present invention to be comparable to those using the control process (of Example 1).

TABLE X

| | Control | | Bleach A | |
|---|---|---|---|---|
| DF | DBF-1 | DB-1 | DBF-2 | DB-2 |
| 0.614 | 0.000 | 0.619 | 0.005 | 0.635 |
| 0.581 | 0.000 | 0.618 | 0.015 | 0.634 |
| 0.577 | 0.000 | 0.638 | 0.012 | 0.624 |
| 0.582 | 0.011 | 0.640 | 0.014 | 0.625 |
| 0.569 | 0.011 | 0.633 | 0.008 | 0.641 |
| 0.553 | 0.002 | 0.651 | 0.011 | 0.637 |
| 0.525 | 0.000 | 0.635 | 0.011 | 0.635 |
| 0.496 | 0.022 | 0.616 | 0.014 | 0.626 |
| 0.429 | 0.003 | 0.635 | 0.005 | 0.630 |
| 0.337 | 0.005 | 0.630 | 0.000 | 0.634 |
| 0.218 | 0.014 | 0.618 | 0.000 | 0.615 |
| 0.118 | 0.004 | 0.641 | 0.008 | 0.637 |
| 0.046 | 0.002 | 0.653 | 0.004 | 0.615 |
| 0.023 | 0.003 | 0.637 | 0.001 | 0.624 |
| 0.018 | 0.000 | 0.624 | 0.008 | 0.613 |
| 0.000 | 0.000 | 0.638 | 0.000 | 0.732 |
| 0.003 | 0.002 | 0.627 | 0.003 | 0.621 |
| 0.012 | 0.005 | 0.665 | 0.000 | 0.623 |
| 0.013 | 0.000 | 0.624 | 0.000 | 0.635 |
| 0.005 | 0.000 | 0.620 | 0.005 | 0.628 |
| 0.000 | 0.000 | 0.648 | 0.000 | 0.624 |

TABLE XI

| | Dmin | | |
|---|---|---|---|
| | R | G | B |
| DBF-1 (control) | 0.109 | 0.096 | 0.113 |
| DBF-2 (invention) | 0.105 | 0.104 | 0.114 |

EXAMPLE 6

This example demonstrates bleaching of commercially available KODAK EDGE 7 Color Paper using the present invention and comparing the invention to processing using the "Separate Bleach and Fixer Option" for conventional Process RA-4. Samples of the color paper were exposed and processed as in Example 1. The residual silver values are shown in TABLE XII. TABLE XIII shows that the Dmin values obtained using the invention were comparable to those measured when the control bleach (of Example 1) was used.

TABLE XII

| | Control | | Bleach A | |
|---|---|---|---|---|
| DF | DBF-1 | DB-1 | DBF-2 | DB-2 |
| 0.389 | 0.011 | 0.406 | 0.017 | 0.402 |
| 0.405 | 0.001 | 0.424 | 0.015 | 0.421 |
| 0.408 | 0.004 | 0.396 | 0.016 | 0.412 |
| 0.411 | 0.006 | 0.414 | 0.014 | 0.423 |
| 0.397 | 0.000 | 0.412 | 0.012 | 0.410 |
| 0.396 | 0.000 | 0.431 | 0.017 | 0.421 |
| 0.374 | 0.001 | 0.411 | 0.012 | 0.415 |
| 0.360 | 0.001 | 0.428 | 0.008 | 0.429 |
| 0.322 | 0.011 | 0.419 | 0.008 | 0.421 |
| 0.261 | 0.000 | 0.412 | 0.006 | 0.403 |
| 0.171 | 0.000 | 0.419 | 0.000 | 0.431 |
| 0.089 | 0.002 | 0.412 | 0.000 | 0.428 |
| 0.036 | 0.001 | 0.414 | 0.001 | 0.407 |
| 0.019 | 0.002 | 0.417 | 0.000 | 0.423 |
| 0.006 | 0.003 | 0.424 | 0.000 | 0.424 |
| 0.000 | 0.000 | 0.427 | 0.000 | 0.415 |
| 0.001 | 0.006 | 0.416 | 0.005 | 0.423 |
| 0.005 | 0.000 | 0.415 | 0.002 | 0.435 |
| 0.000 | 0.003 | 0.416 | 0.000 | 0.420 |
| 0.005 | 0.002 | 0.417 | 0.004 | 0.425 |
| 0.010 | 0.004 | 0.393 | 0.011 | 0.417 |

TABLE XIII

| | Dmin | | |
|---|---|---|---|
| | R | G | B |
| DBF-1 (control) | 0.093 | 0.084 | 0.073 |
| DBF-2 (invention) | 0.095 | 0.089 | 0.076 |

EXAMPLE 7

This example demonstrates that periodate bleaches with higher acidity levels are preferable in the practice of this invention because the minimum density levels are controlled better. In this example, acidity levels were varied by changing the concentration of a common buffering acid in three otherwise identical periodate bleaching compositions.

Example 1 was repeated using Bleaching Compositions E, F and G and the bleach time was 60 seconds. The method using Composition E is outside the present invention because the acid concentration is too low.

| | |
|---|---|
| Bleaching Composition E | |
| Sodium periodate | 2.14 grams |
| Sodium chloride | 2.93 grams |
| Sulfuric acid (0.045 molar in water) to pH = 1.28 | 1 liter |
| Bleaching Composition F | |
| Sodium periodate | 2.14 grams |
| Sodium chloride | 2.93 grams |
| Sulfuric acid (0.090 molar in water) to pH = 1.08 | 1 liter |
| Bleaching Composition G | |
| Sodium periodate | 2.14 grams |
| Sodium chloride | 2.93 grams |
| Sulfuric acid (0.18 molar in water) to pH = 1.08 | 1 liter |

The residual silver values are shown below in Table XIV. A comparison of the minimum densities with respect to the control is shown in Table XV. The results in Table XIV show that the three bleaching compositions E, F and G work equally well as silver retentive bleaching solutions. The results in Table XV show that the minimum density in strips fully processed in the current process relative to the minimum density in strips processed using the control bleach (like Example 1) decreases as the acid level is increased (that is, as pH is decreased).

TABLE XIV

| | Bleach E | | Bleach F | | Bleach G | |
|---|---|---|---|---|---|---|
| DF | DBF-3 | DB-3 | DBF-2 | DB-2 | DB-2 | DB-2 |
| 0.538 | 0.000 | 0.561 | 0.003 | 0.581 | 0.033 | 0.557 |
| 0.534 | 0.000 | 0.562 | 0.000 | 0.581 | 0.030 | 0.566 |
| 0.510 | 0.000 | 0.565 | 0.011 | 0.577 | 0.033 | 0.564 |
| 0.524 | 0.001 | 0.564 | 0.010 | 0.550 | 0.029 | 0.584 |
| 0.507 | 0.000 | 0.568 | 0.000 | 0.549 | 0.024 | 0.564 |
| 0.509 | 0.009 | 0.570 | 0.000 | 0.566 | 0.033 | 0.556 |
| 0.481 | 0.000 | 0.552 | 0.000 | 0.567 | 0.036 | 0.567 |
| 0.443 | 0.001 | 0.585 | 0.005 | 0.566 | 0.012 | 0.574 |
| 0.395 | 0.006 | 0.547 | 0.014 | 0.564 | 0.024 | 0.569 |
| 0.329 | 0.000 | 0.566 | 0.006 | 0.574 | 0.018 | 0.577 |
| 0.243 | 0.000 | 0.563 | 0.000 | 0.573 | 0.000 | 0.576 |
| 0.146 | 0.000 | 0.573 | 0.012 | 0.559 | 0.000 | 0.572 |
| 0.074 | 0.000 | 0.557 | 0.000 | 0.569 | 0.000 | 0.561 |
| 0.026 | 0.000 | 0.576 | 0.000 | 0.571 | 0.012 | 0.567 |
| 0.014 | 0.000 | 0.551 | 0.009 | 0.580 | 0.000 | 0.587 |
| 0.009 | 0.000 | 0.554 | 0.000 | 0.567 | 0.000 | 0.574 |
| 0.002 | 0.000 | 0.591 | 0.000 | 0.574 | 0.000 | 0.536 |
| 0.000 | 0.000 | 0.563 | 0.005 | 0.580 | 0.000 | 0.566 |
| 0.000 | 0.000 | 0.566 | 0.001 | 0.580 | 0.000 | 0.561 |
| 0.002 | 0.000 | 0.551 | 0.002 | 0.582 | 0.000 | 0.581 |
| 0.011 | 0.000 | 0.566 | 0.000 | 0.556 | 0.000 | 0.562 |

TABLE XV

| | | Dmin | | |
|---|---|---|---|---|
| Bleach | sample | R | G | B |
| Color Paper Bleach E | control | 0.106 | 0.104 | 0.120 |
| | DBF-3 | 0.159 | 0.130 | 0.143 |
| Color Paper Bleach F | control | 0.113 | 0.112 | 0.127 |
| | DBF-2 (invention) | 0.122 | 0.118 | 0.134 |
| Color Paper Bleach G | control | 0.105 | 0.104 | 0.120 |
| | DBF-2 (invention) | 0.110 | 0.107 | 0.123 |

EXAMPLE 8

This example demonstrates that periodate bleaching compositions having higher acidity levels (lower pH) are preferable in the bleaching method of the present invention because such solutions control the minimum density levels in strips fully processed according to the present invention. In this example, the pH of bleaching compositions having identical periodate and chloride concentrations were varied by replacing sulfuric acid with acids of lower acid strength.

Example 1 was repeated except that Bleaching Compositions H and I were used and the bleach time was 60 seconds. The method using Composition H is outside the present invention because the Composition H pH is too high. The use of Composition I is within the present invention.

| Bleaching Composition H | |
|---|---|
| Sodium periodate | 2.14 grams |
| Sodium chloride | 2.93 grams |
| Glacial acetic acid | 15.0 grams |
| Water to | 1 liter |
| pH = 2.56 | |
| **Bleaching Composition I** | |
| Sodium periodate | 2.14 grams |
| Sodium chloride | 2.93 grams |
| Phosphoric acid (85 wt % in water) | 23.0 grams |
| Water to | 1 liter |
| pH = 1.24 | |

The residual silver data are shown below in TABLE XVI. A comparison of the minimum densities with respect to the control (of Example 1) is shown in TABLE XVII. The results in Table XVI show that both Bleaching Compositions H and I are effective at desilvering the developed color paper, but the data in Table XVII show that bleaching at the lower pH is needed to reduce Dmin to an acceptable level.

TABLE XVI

| | Bleach H | | Bleach I | |
|---|---|---|---|---|
| DF | DBF-3 | DB-3 | DBF-2 | DB-2 |
| 0.521 | 0.000 | 0.577 | 0.005 | 0.581 |
| 0.522 | 0.000 | 0.590 | 0.002 | 0.561 |
| 0.502 | 0.011 | 0.588 | 0.014 | 0.580 |
| 0.503 | 0.000 | 0.572 | 0.022 | 0.583 |
| 0.485 | 0.005 | 0.581 | 0.013 | 0.568 |
| 0.472 | 0.000 | 0.570 | 0.017 | 0.579 |
| 0.464 | 0.010 | 0.569 | 0.016 | 0.590 |
| 0.424 | 0.000 | 0.582 | 0.008 | 0.580 |
| 0.384 | 0.011 | 0.586 | 0.018 | 0.578 |
| 0.313 | 0.014 | 0.566 | 0.015 | 0.590 |
| 0.228 | 0.002 | 0.590 | 0.000 | 0.573 |
| 0.141 | 0.000 | 0.574 | 0.004 | 0.570 |
| 0.083 | 0.000 | 0.585 | 0.012 | 0.555 |
| 0.034 | 0.003 | 0.581 | 0.002 | 0.592 |
| 0.012 | 0.000 | 0.585 | 0.006 | 0.568 |
| 0.015 | 0.000 | 0.574 | 0.011 | 0.578 |
| 0.012 | 0.004 | 0.555 | 0.003 | 0.579 |
| 0.011 | 0.011 | 0.563 | 0.009 | 0.572 |
| 0.004 | 0.003 | 0.583 | 0.012 | 0.590 |
| 0.002 | 0.000 | 0.549 | 0.008 | 0.586 |
| 0.005 | 0.000 | 0.561 | 0.009 | 0.567 |

TABLE XVII

| | | Dmin | | |
|---|---|---|---|---|
| Bleach | Sample | R | G | B |
| Color Paper Bleach H | control | 0.117 | 0.117 | 0.129 |
| | DBF-3 | 0.144 | 0.175 | 0.204 |
| Color Paper Bleach I | control | 0.113 | 0.112 | 0.125 |
| | DBF-2 (invention) | 0.120 | 0.121 | 0.145 |

EXAMPLE 9

This example demonstrates that for periodate bleaching compositions useful in the present invention, lower periodate concentrations are preferred at the same acidity level (pH). The lower periodate concentrations generate less undesirable Dmin.

Example 1 was repeated using Bleaching Compositions J, K and L, and the bleach time was 60 seconds. Bleach compositions K and L are outside the scope of the present invention because the periodate concentrations are above 0.05 mol/l.

| Bleaching Composition J | |
|---|---|
| Sodium periodate | 10.7 grams |
| Sodium chloride | 5.84 grams |
| Sulfuric acid (0.18 molar in water) to | 1 liter |
| pH = 1.02 | |
| **Bleaching Composition K** | |
| Sodium periodate | 16.0 grams |
| Sodium chloride | 5.84 grams |
| Sulfuric acid (0.18 molar in water) to | 1 liter |
| pH = 1.06 | |
| **Bleaching Composition L** | |
| Sodium periodate | 21.4 grams |
| Sodium chloride | 5.84 grams |
| Sulfuric acid (0.18 molar in water) to | 1 liter |
| pH = 0.75 | |

TABLES XVIII and XIX show the residual silver and Dmin data, respectively. The results show that all three Bleaching Compositions J, K, and L were effective at desilvering the developed color paper, and the data in Table XIX show that the higher the periodate concentration, the higher the increase in Dmin relative to strips processed in the control process (of Example 1).

TABLE XVIII

| | Bleach J | | Bleach K | | Bleach L | |
|---|---|---|---|---|---|---|
| DF | DBF-2 | DB-2 | DBF-3 | DB-3 | DBF-3 | DB-3 |
| 0.536 | 0.000 | 0.565 | 0.000 | 0.561 | 0.003 | 0.579 |
| 0.537 | 0.017 | 0.577 | 0.000 | 0.580 | 0.000 | 0.574 |
| 0.523 | 0.000 | 0.564 | 0.000 | 0.583 | 0.000 | 0.588 |
| 0.526 | 0.000 | 0.579 | 0.000 | 0.570 | 0.000 | 0.573 |
| 0.506 | 0.000 | 0.563 | 0.000 | 0.570 | 0.004 | 0.574 |
| 0.512 | 0.000 | 0.592 | 0.000 | 0.569 | 0.015 | 0.570 |
| 0.486 | 0.004 | 0.572 | 0.001 | 0.551 | 0.000 | 0.572 |
| 0.446 | 0.002 | 0.579 | 0.000 | 0.580 | 0.001 | 0.564 |
| 0.401 | 0.000 | 0.551 | 0.006 | 0.567 | 0.004 | 0.570 |
| 0.327 | 0.000 | 0.554 | 0.015 | 0.583 | 0.000 | 0.571 |
| 0.241 | 0.000 | 0.581 | 0.000 | 0.568 | 0.000 | 0.577 |
| 0.150 | 0.000 | 0.578 | 0.000 | 0.554 | 0.002 | 0.557 |
| 0.075 | 0.003 | 0.567 | 0.002 | 0.572 | 0.004 | 0.559 |
| 0.026 | 0.001 | 0.578 | 0.006 | 0.578 | 0.005 | 0.568 |
| 0.015 | 0.000 | 0.564 | 0.000 | 0.562 | 0.000 | 0.569 |
| 0.008 | 0.004 | 0.568 | 0.013 | 0.586 | 0.000 | 0.577 |
| 0.001 | 0.009 | 0.553 | 0.000 | 0.570 | 0.000 | 0.580 |
| 0.002 | 0.003 | 0.570 | 0.000 | 0.574 | 0.000 | 0.555 |
| 0.002 | 0.000 | 0.585 | 0.000 | 0.572 | 0.000 | 0.569 |
| 0.001 | 0.000 | 0.576 | 0.011 | 0.580 | 0.000 | 0.573 |
| 0.006 | 0.000 | 0.570 | 0.000 | 0.567 | 0.003 | 0.583 |

TABLE XIX

| | | Dmin | | |
|---|---|---|---|---|
| Bleach | sample | R | G | B |
| Color Paper Bleach J | control | 0.116 | 0.114 | 0.131 |
| | DBF-2 (invention) | 0.132 | 0.129 | 0.145 |
| Color Paper Bleach K | control | 0.114 | 0.113 | 0.127 |
| | DBF-3 | 0.177 | 0.162 | 0.169 |
| Color Paper Bleach L | control | 0.112 | 0.111 | 0.126 |
| | DBF-3 | 0.234 | 0.211 | 0.201 |

The invention has been described in detail with particular reference to preferred embodiments thereof, but it will be understood that variations and modifications can be effected within the spirit and scope of the invention.

We claim:

1. A method of processing comprising the steps of:

A) color developing an imagewise exposed silver halide color photographic element, and B) without intervening processing steps, bleaching said element with a photographic bleaching composition having a pH of less than 2, and comprising:

a) periodate, or a source of periodate, at a concentration of from about 0.01 to about 0.05 mol/l, b) chloride ions at a concentration of at least 0.01 mol/l, and c) at least one acid with a pKa less than 2, at a concentration greater than or equal to 0.05 mol/l.

2. The method of claim 1 wherein said color photographic element is a color element comprising a silver halide emulsion having more than 50 mol % silver chloride and less than 1 mol % silver iodide.

3. The method of claim 1 wherein said color element comprises a silver halide emulsion having more than 95 mol % silver chloride.

4. The method of claim 3 wherein said color element is a color paper.

5. The method of claim 1 wherein step B is carried out for at least 30 seconds.

6. The method of claim 1 wherein said periodate is an alkali metal periodate.

7. The method of claim 1 wherein said periodate is present in said bleaching composition at from about 0.01 to about 0.025 mol/l, chloride ions are present at from about 0.01 to about 1 mol/l, and said acid is present at a concentration of greater than or equal to 0.1 mol/l.

8. The method of claim 1 wherein said bleaching composition has a pH of less than 1.5.

9. The method of claim 8 wherein said bleaching composition has a pH of less than 1.25.

10. A method of processing comprising the steps of:

A) color developing an imagewise exposed high silver chloride color paper, and

B) without intervening processing steps, bleaching said color paper with a photographic bleaching composition having a pH of less than 1.5, and comprising:

a) an alkali metal periodate at a concentration of from about 0.01 to about 0.025 mol/l, b) chloride ion present at from about 0.01 to about 0.1 mol/l, and c) at least one acid with a pKa less than 2, present at a concentration greater than or equal to 0.1 mol/l.

11. The method of claim 10 wherein said color paper has three separate color records, each color record having a silver halide emulsion layer comprising at least 95 mol % silver chloride.

12. The method of claim 10 wherein step B is carried out within 30 seconds.

13. The method of claim 10 wherein said bleaching composition has a pH of less than 1.25.

* * * * *